US006523859B2

(12) United States Patent
Scheggetman et al.

(10) Patent No.: US 6,523,859 B2
(45) Date of Patent: Feb. 25, 2003

(54) TAMPER-EVIDENT FORM

(75) Inventors: Bernard Willem "Wim" Scheggetman, Bangkok (TH); Chuck Casagrande, Kent (GB); Joel Bryan Van Boom, Santa Ana, CA (US)

(73) Assignee: Documotion Research, Inc., Wilmington, DE (US)

( * ) Notice: Subject to any disclaimer, the term of this patent is extended or adjusted under 35 U.S.C. 154(b) by 0 days.

(21) Appl. No.: 09/952,142

(22) Filed: Sep. 14, 2001

(65) Prior Publication Data

US 2002/0056990 A1 May 16, 2002

Related U.S. Application Data

(63) Continuation of application No. PCT/AU00/00191, filed on Mar. 14, 2000.

(30) Foreign Application Priority Data

Mar. 16, 1999 (AU) ..... PP9313

(51) Int. Cl.[7] ..... B42D 15/00

(52) U.S. Cl. ..... 283/70; 283/99; 283/100; 283/109; 428/199; 428/915; 428/916

(58) Field of Search ..... 283/72, 82, 83, 283/91, 93, 94, 114, 98, 99, 100, 901, 67, 70; 428/198, 199, 209, 343, 352, 354, 472, 915, 916; 101/32

(56) References Cited

U.S. PATENT DOCUMENTS

| | | | | |
|---|---|---|---|---|
| 4,389,472 A | | 6/1983 | Neuhaus et al. | 430/10 |
| 5,149,386 A | * | 9/1992 | Smits et al. | 156/150 |
| 5,234,732 A | * | 8/1993 | Versic | 428/35.7 |
| 5,551,729 A | | 9/1996 | Morgan | 283/94 |
| 6,004,656 A | * | 12/1999 | Gosselin et al. | 428/198 |

* cited by examiner

*Primary Examiner*—Willmon Fridie, Jr.
(74) *Attorney, Agent, or Firm*—St. Onge Steward Johnston & Reens LLC

(57) ABSTRACT

Confidential information is printed on an upper transparent laminate. A scrambling pattern is associated with a lower laminate. The upper surface of the lower laminate and the lower surface of the upper laminate are complementary in shape such that the upper laminate appears transparent, but alters to appear translucent when separated from the lower laminate. This provides a tamper-evident mechanism for indicating separation of the laminates.

7 Claims, 2 Drawing Sheets

TAMPER-EVIDENT FORM

The present application is a continuation of pending International Patent Application PCT/AU00/00191 filed on Mar. 14, 2000, which designates the United States, and which claims prioriy of Australian Provisional Patent Application PP9313 filed on Mar. 16, 1999.

FIELD OF THE INVENTION

This invention relates to an improvement of the tamper-evident form disclosed in International Patent Application PCT/AU98/00787 filed Sep. 18, 1998 claiming priority from Australian Provisional Patent Application PP0273 filed Nov. 7, 1997.

The disclosure of International Patent Application PCT/AU98/00787 is hereby incorporated by cross-reference and a complete understanding of the present invention requires reference to the above document.

BACKGROUND OF INVENTION

International Patent Application PCT/AU98/00787 discloses a tamper-evident form for securely carrying information. Confidential information can be printed on the form with a non-impact printer (eg. laser printer or ink jet printer) and the form does not require further processing (eg. folding or coating etc) after printing in order to render the confidential information printed on the form secure. As such, it represents a significant advance over the previous known art in the field of secure forms.

A number of the preferred embodiments disclosed in PCT/AU98/00787 involve a multi-ply construction involving a transparent laminate and an underlying substrate which bears a scrambling pattern which is visible through the transparent laminate such that information printed on the transparent laminate cannot be read or ascertained until the transparent laminate and underlying scrambling pattern are physically separated.

In some embodiments an incomplete die cut (which leaves frangible ties) is provided in either the substrate or the transparent laminate and a portion of the substrate or a portion of the laminate is removable from the remainder of the substrate or laminate, respectively, to thereby render the confidential information on the transparent laminate visible.

These embodiments rely on frangible ties in the substrate or laminate, respectively, to indicate tampering. A concern with these embodiments is the fact that detection of tampering is reliant on the user observing the fact that the frangible ties are broken. A further concern is that the entire laminate could be lifted away from the substrate without breaking the frangible ties and thereafter the entire laminate could be carefully replaced on the substrate with there being no evidence of tampering at all.

SUMMARY OF THE INVENTION

According to a first aspect, the invention resides in a tamper-evident form including:

a transparent upper laminate having a textured lower surface and adapted to receive confidential information on its upper surface;

a lower laminate having a complementary textured upper surface such that the upper laminate appears transparent and such that the upper laminate appears noticeably less transparent when it is separated from the lower laminate and the complementary textured surfaces are exposed.

According to a second aspect, the invention resides in a tamper-evident form including:

a transparent upper laminate adapted to receive confidential information; and a lower laminate, wherein the upper surface of the lower laminate and the lower surface of the upper laminate are complementary in shape such that separation of the upper and lower laminates exposes that complementary surfaces and decreases the transparency of at least the upper laminate.

According to a third aspect the invention resides in a tamper-evident form including:

an upper laminate bonded to a lower laminate, the arrangement being such that, when bonded, the combined laminates are transparent and, when separated, the separated laminates are noticeably less transparent.

According to a fourth aspect the invention resides in a method of indicating separation of a first transparent laminate and a second laminate, wherein the first transparent laminate is adapted to receive confidential information and wherein the second laminate includes an associated scrambling pattern which prevents reading of the confidential information, the method including:

forming complementary textured surfaces at the juncture of the first and second laminates, whereby separation of the laminates exposes the complementary textured surfaces and alters the optical properties of at least the first transparent laminate.

DETAILED DESCRIPTION OF THE DRAWINGS

Figure 1:
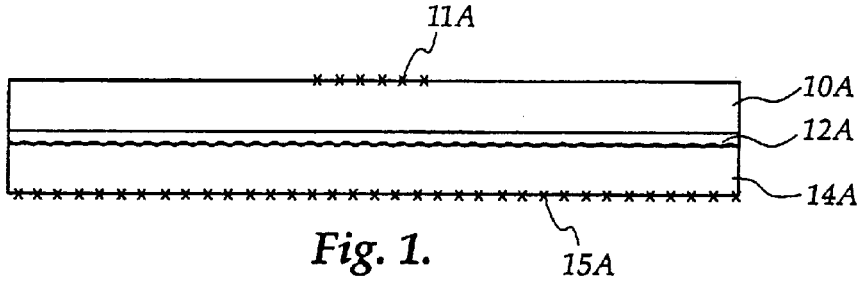
FIG. 1 is a cross sectional view of a first tamper-evident form.

With reference firstly to FIG. 1 there is shown an arrangement in which upper transparent laminate 10A (for example made of polyester) is coated on its lower surface with a transparent coating 12A (for example made of water-based acrylic polymers with a blend of fillers). Transparent coating 12A bonds to upper transparent laminate 10A and produces a matt or textured finish on the lower surface of transparent coating 12A as schematically shown by the "wavy" line.

The lower laminate 14A (for example made of acrylic or polyurethane) is, in the preferred mode of manufacture, cast in liquid form directly onto the textured lower surface of coating 12A and cures in place. Accordingly, the upper surface of lower laminate 14A is complementary in shape to the matt or textured lower surface of the coating 12A. Upon curing, coating 12A and lower laminate 14A are mechanically bonded together by virtue of the intimate contact between their complementary textured surfaces.

Whilst the textured lower surface of the coating 12A would have a refractivity characteristic which would result in the combined upper transparent laminate 10A and transparent coating 12A appearing cloudy or translucent, the fact that the upper surface of the lower laminate 14A is of perfectly complementary texture, together with the intimate contact of the lower surface of coating 12A and upper surface of lower laminate 14A, results in the combined upper laminate 10A and coating 12A appearing transparent rather than translucent.

In this particular embodiment, the lower laminate 14A is also transparent and has a scrambling pattern 15A printed on its lower surface. In other embodiments the scrambling pattern could be embodied within the lower laminate, or indeed the scrambling pattern could conceivably comprise the complementary textured upper surface of the lower laminate.

The scrambling pattern 15A is visible from above through the upper laminate 10A, coating 12A and lower laminate 14A, all of which it will be recalled are transparent. The scrambling pattern 15A may consist of a mass of overprinted alpha-numeric characters as is known in the art or could simply be a dark background.

It will be understood that the presence of any confidential information 11A printed on the upper surface of the upper laminate 10A by a laser printer or ink jet printer, for example, cannot be ascertained due to the fact that the printed confidential information 11A is scrambled or masked by the underlying scrambling pattern 15A.

Any physical separation of the combined upper laminate 10A and coating 12A from the lower laminate 14A results in an alteration of the optical properties of the combined upper laminate 10A and coating 12A. A similar alteration occurs to the optical properties of the lower laminate 14A.

Specifically, the combined upper laminate 10A and coating 12A takes on a cloudy or translucent appearance due to the exposure of the matt or textured finish of the now-exposed lower surface of the coating 12A which alters the optical properties of the combined upper laminate 10A and coating 12A. The lower laminate 14A equally takes a translucent or cloudy appearance which makes the underlying scrambling pattern 15A less visible than prior to separation. This translucent appearance after separation is, of course, simply a function of the refractivity of the exposed textured surfaces. Thus, in summary, separation causes a change from transparent to translucent which is readily evident to the viewer.

It will be appreciated that the change of appearance from transparent to translucent on physical separation is irreversible. Furthermore, because the nature of the bond between the combined upper laminate 10A and coating 12A and the lower laminate 14A was mechanical (ie. the intimate and complementary engagement of the respective textured surfaces), the coating 12A and lower laminate 14A cannot be re-adhered together.

Figure 2:
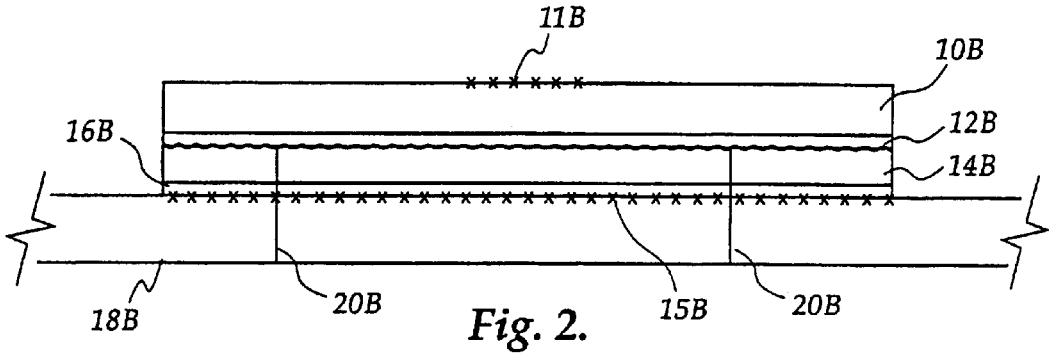
FIG. 2 is a cross sectional view of a second tamper-evident form.

Referring now to the second embodiment shown in FIG. 2, this embodiment is similar to the first embodiment in that it includes an upper transparent laminate 10B, transparent coating 12B and lower transparent laminate 14B. Again, the coating 12B presents a textured surface upon which the lower laminate 14B is cast in liquid form such that the upper surface of the lower laminate 14B adopts a complementary textured finish to the lower textured surface of the coating 12B.

Once again, upper laminate 10B, coating 12B and lower laminate 14B are all transparent. However, in this embodiment, the scrambling pattern 15B is printed on the upper surface of paper substrate 18B. Lower laminate 14B is adhered to substrate 18B via a transparent adhesive 16B and a die-cut 20B is provided from the rear of the form such that a portion of the paper substrate 18B together with a portion of the lower transparent laminate 14B is removable from the remainder of the form.

In use, confidential information 11B is printed on the upper surface of the upper laminate 10B by, for example, a laser printer or ink jet printer. The upper surface of the upper laminate 10B may have a slightly matt finish to enhance bonding of applied printer toner to the upper laminate 10B and also to inhibit acute reflections of light which may otherwise facilitate reading of the confidential information. Again, it will be appreciated that the confidential information 11B cannot be read at this stage due to the underlying scrambling pattern 15B which is printed on the paper substrate 18B and which is clearly visible through the upper laminate 10B, coating 12B, lower laminate 14B and adhesive 16B, all of which are transparent.

It should be noted that providing a slightly matt finish to the upper surface of the upper laminate 10B for the purpose of enhancing the bonding of toner to the upper laminate 10B must not compromise the overall transparency of the laminated structure as this would compromise the functionality of the underlying scrambling pattern 15B.

Access to the confidential information 11B is achieved via manual removal of the portion of the paper substrate 18B and lower laminate 14B within the die-cut 20B. Separation renders the confidential information 11B visible and also breaks the mechanical bond between coating 12B and laminate 14B and also exposes the respective complementary textured finishes of the coating 12B and lower laminate 14B thereby rendering both translucent or milky white in appearance.

In the event that an attempt is made to lift the upper laminate 10B and coating 12B from the front of the form to obtain illegal access to the confidential information 11B, then again the textured surfaces of the release coating 12B and lower laminate 14B are exposed thereby causing a change of appearance which indicates tampering. Again, advantageously the combined upper laminate 10B and coating 12B cannot be replaced because they will not re-adhere to lower laminate 14B once the intimate mechanical bond between the coating 12B and lower laminate 14B has been broken.

Figure 3:
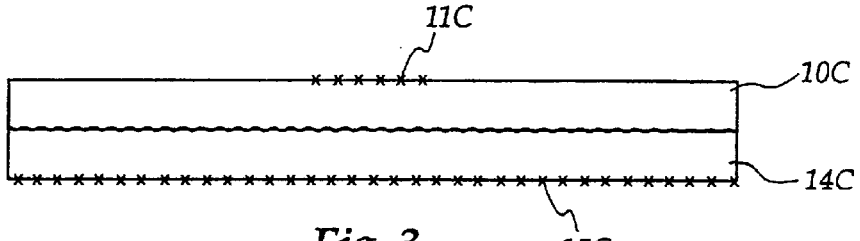
FIG. 3 is a cross sectional view of a third tamper-evident form.
Figure 4:
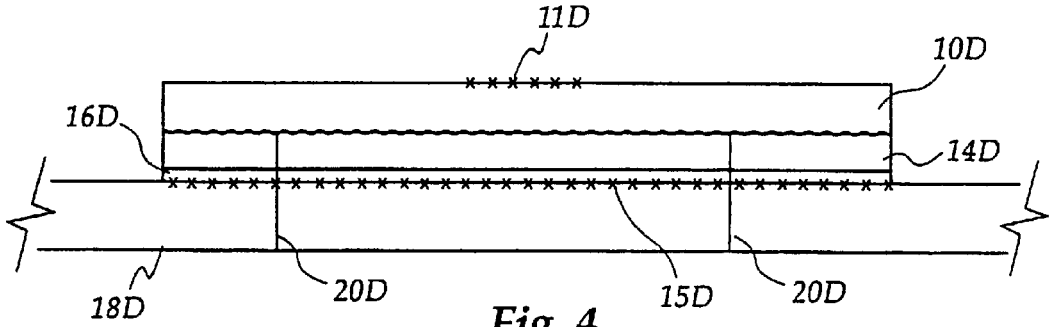
FIG. 4 is a cross sectional view of a fourth tamper-evident form.

Referring to FIGS. 3 and 4, there are illustrated embodiments in which the coating 12 has been dispensed with and the lower surface of upper laminate 10 has been directly textured instead. This may be achieved, for example, by chemical etching or mechanical abrasion or simply by selecting a suitable matt finish polyester film, for example.

Referring to FIG. 3, lower laminate 14C is cast directly onto upper laminate 10C with the result being an optically clear dual laminate construction. Again, physical separation of the laminates 10C and 14C exposes the respective complementary textured surfaces and results in both the upper and lower laminates 10C and 14C taking a translucent appearance which is readily distinguishable from their prior transparent character. Further, the upper and lower laminates 10C and 14C cannot be re-adhered together after the mechanical bond has been broken. In this embodiment, the scrambling pattern 15C is printed on the lower surface of the lower laminate 14C.

FIG. 4 illustrates the embodiment of FIG. 3 in which the dual laminate construction is adhered via transparent adhesive 16D to a paper substrate 18D. In this embodiment, the scrambling pattern 15D is printed on the upper surface of the paper substrate 18D. Die cut 20D from the rear facilitates removal of a portion of substrate 18D and lower laminate 14D. Again, physical separation of upper laminate 10D and lower laminate 14D results in an irreversible visual indicator of tampering. Further, the intimate mechanical bond between the upper and lower laminates 10D and 14D cannot be re-established.

Figure 5:
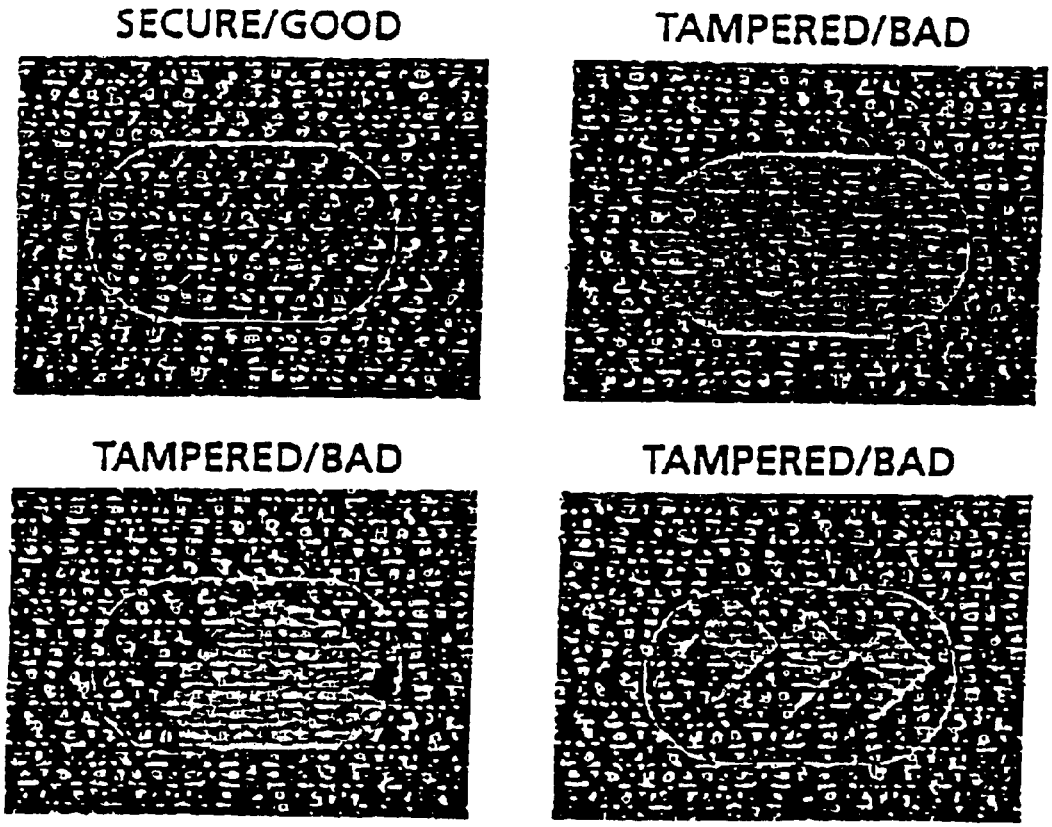
FIG. 5 is an illustration of the appearance of several tampered forms and an un-tampered form.

Referring to FIG. 5 there are illustrated several examples of tamper indication in respect of the embodiments shown in FIGS. 2 and 4. The die cut from the rear of the form is shown as being generally oval in shape.

In the top right example, the oval-shaped die cut portion of the substrate and lower laminate have been removed from the rear and then replaced leaving an indication of separation within the oval-shaped die cut.

In the bottom two examples an attempt has been made to lift portions of upper laminate which has torn as a result. In preferred embodiments, the upper laminate 10 is deliberately scored, preferably in a criss-cross pattern, so that the upper laminate ruptures if an attempt is made to lift the upper laminate with, for example, adhesive tape or the like.

In summary, International Patent Application PCT/AU98/00787 disclosed a tamper-evident form for securely carrying confidential information in which the confidential information could only be read when the laminate bearing the confidential information and the underlying scrambling pattern were physically separated. The present application discloses an improved tamper-evident form in which any physical separation of the laminate bearing the confidential information and the underlying scrambling pattern is irreversibly indicated.

It will be understood that the foregoing examples are representative of the invention. All modifications and variations as would be apparent to persons skilled on the art are deemed to fall within the scope of the invention as set forth.

What is claimed is:

1. A tamper-evident form including:

an upper laminate formed of transparent material and having a textured lower surface, the upper laminate being adapted to receive confidential information on its upper surface;

a lower laminate bonded to the upper laminate and also formed of transparent material, the lower laminate having a complementary textured upper surface such that the combined upper and lower laminates appear transparent;

a scrambling pattern associated with the lower laminate, the scrambling pattern being clearly visible through the transparent combined upper and lower laminates such that confidential information on the upper surface of the upper laminate cannot be read, and wherein at least the upper laminate appears noticeably less transparent when it is separated from the lower laminate and the complementary textured surfaces are exposed.

2. A tamper-evident form as claimed in claim 1, wherein the scrambling pattern is printed on the lower surface of the lower laminate.

3. A tamper-evident form as claimed in claim 1, wherein the lower laminate is adhered to a substrate and wherein the scrambling pattern is printed on the upper surface of the substrate.

4. A tamper-evident form as claimed in claim 1, wherein the textured lower surface of the upper laminate is produced by application of a coating to the lower surface of the upper laminate.

5. A tamper-evident form as claimed in claim 1, wherein the lower laminate is cast in place on the textured lower surface of the upper laminate.

6. A tamper-evident form as claimed in claim 4, wherein the lower laminate is cast in place on the coating.

7. A method of indicating separation of a first laminate formed of transparent material and a second laminate formed of transparent material, wherein the first laminate is adapted to receive confidential information and wherein the second laminate includes an associated scrambling pattern which prevents reading of the confidential information, the method including:

forming complementary textured surfaces at the juncture of the first and second laminates such that the combined first and second laminates are transparent, whereby separation of the laminates exposes the complementary textured surfaces and alters the transparency of at least the first transparent laminate.

* * * * *